United States Patent [19]

Bale et al.

[11] Patent Number: 4,620,553

[45] Date of Patent: Nov. 4, 1986

[54] TOBACCO SMOKE FILTERS

[75] Inventors: Christopher R. Bale, Keynsham; Beresford R. Gill, Paulton, Nr. Bristol, both of England

[73] Assignee: Imperial Group Public Limited Company, London, England

[21] Appl. No.: 733,857

[22] Filed: May 14, 1985

[30] Foreign Application Priority Data

May 22, 1984 [GB] United Kingdom ..... 8413017
May 22, 1984 [GB] United Kingdom ..... 8413018

[51] Int. Cl.[4] ..... A24D 3/04

[52] U.S. Cl. ..... 131/198.1; 131/215.1; 131/215.2; 131/215.3; 131/336

[58] Field of Search ..... 131/336, 215.1, 215.2, 131/215.3, 198.1, 198.2

[56] References Cited

U.S. PATENT DOCUMENTS 3,628,543 12/1971 Bemont ..... 131/215.3
3,685,522 8/1972 Kleinhaus ..... 131/215.3

*Primary Examiner*—V. Millin
*Attorney, Agent, or Firm*—Larson and Taylor

[57] ABSTRACT

A filter for a smoking article employing a resilient valve assembly in the path of the smoke. The valve assembly being movable in a first position in which the flow ventilating air is permitted and a second position in which the flow of air is prevented. The valve assembly being resiliently biased towards the first position and being displaceable towards the second position when a particular pressure differential is exceeded.

13 Claims, 5 Drawing Figures

TOBACCO SMOKE FILTERS

This invention concerns improvements in or relating to a filter assembly for an elongate smoking article, in particular to an improved ventilated filter assembly for a cigarette.

It is known to provide ventilation into a cavity in a cigarette filter so that smoke passing into the filter from burning tobacco will intermingle with ventilating air in the cavity before proceeding to the smoker's mouth. Such a filter will be referred to as "of the type described".

A disadvantage of ventilated filters is that the smoker is unable to control the degree of ventilation and hence the ratio of smoke to ventilating air entering the smoker's mouth.

The present invention enables the smoker to exert a measure of control over the ratio of smoke to ventilating air in the cavity of a filter of the type described.

According to a first aspect of the present invention there is provided, for attachment to a rod of smokable material, a filter assembly of the type described, comprising, (a) first and second axially spaced cylindrical filter plug elements so arranged that when the assembly is attached to the rod of smokable material the first element is adjacent the rod, (b) a tube of air-impervious material open at both ends separating and in axial alignment with said filter elements, the tube being provided in its cylindrical wall with at least one ventilating aperture, (c) a tipping wrapper encasing the cylindrical surfaces of the filter elements and the tube, the tipping wrapper being provided with ventilation means overlying said at least one ventilating aperture, and (d) resilient valve means adapted to prevent the passage of ventilating air through said at least one ventilating aperture when a predetermined pressure differential between the ventilating air flow through said at least one ventilating aperture and the flow of combustion products through the tube is exceeded, and to permit the passage of ventilating air through said at least one ventilating aperture when said pressure differential is not exceeded.

In a first embodiment of the invention the resilient valve means may be provided by a resiliently mounted piston axially slidable within the tube, the piston being provided with an aperture in its crown to permit the passage of combustion products therethrough, the arrangement being such that when the piston is located in a first region of the tube the piston will seal off said at least one ventilating aperture and when the piston is located in a second region of the tube between the first region and the first filter element said at least one ventilating aperture will be uncovered by the piston, the resilient mounting of the piston being such as to urge the piston from the first region towards the second region and the resilience of the mounting being such that a predetermined flow of combustion products through the assembly will overcome the resilience so as to re-position the piston in the first region.

The resilient mounting of the piston is preferably provided by a compression spring effecting a connection between the base of the piston and a face of the second filter element.

The compression spring may be a filament spring.

The piston and the resilient mounting are preferably a one-piece moulding of plastics material.

In a second embodiment of the invention the resilient valve means may be a flap valve means associated with said at least one ventilating aperture.

The flap valve means is preferably provided by a pair of overlapping members, one of which is flexible, each member being provided by an end portion of a respective one of a pair of opposed hollow cylinders of synthetic resin located within and coaxial with the tube.

Each overlapping number preferably tapers towards its free end.

The tube is preferably provided with a circumferential channel in its outer surface, such that said at least one ventilating aperture lies in the base of the channel and provides communication between the channel and the interior of the tube, and the ventilation means of the tipping wrapper overlies the channel.

The ventilation means in the tipping wrapper is peferably provided by a circumferential series of ventilation holes or by a circumferential region of high porosity paper.

Preferably there is provided a series of said at least one ventilating apertures spaced circumferentially round the tube.

According to a second aspect of the present invention there is provided a cigarette comprising the combination of a wrapped rod of smokable material with a filter assembly according to the first aspect of the invention.

The invention will now be described by way of example only with reference to the accompanying diagrammatic drawings in which, FIG. 1 is a perspective view of a cigarette including a wrapped tobacco rod and a partially unwrapped filter assembly according to the invention;

Figure 1:
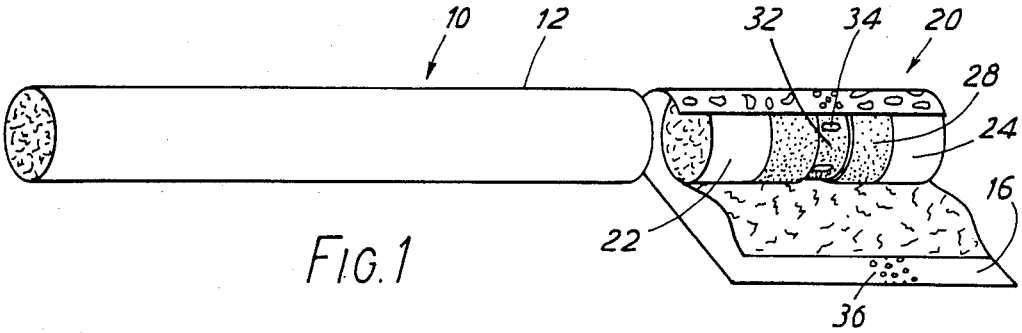

Referring to FIG. 1 of the drawings there is shown a cigarette 10 comprising a cylindrical tobacco rod 12 wrapped in cigarette paper 14, and a filter assembly 20 attached to the tobacco rod.

The filter assembly 20 comprises two spaced coaxial cylindrical filter elements 22, 24 of cellulose acetate fibre wrapped in plugwrap 26, and, separating the filter elements, an impervious synthetic resin tube 28, open at both ends, coaxial with, and of the same diameter as, the filter elements. The tube 28 thus provides a chamber 30 (not visible in FIG. 1) between facing ends of the filter elements 22, 24.

The tube 28 and the filter elements 22, 24 are wrapped in tipping paper 16 which is used to attach the filter assembly to the tobacco rod in a manner common in the art so that filter element 22 abuts the tobacco rod 12.

The tube 28 is provided about half-way along its length with a circumferential channel 32 in its outer surface. The floor of the channel 32 is provided with a number of apertures 34 spaced evenly round the circumference of the tube and communicating with the chamber 30. The tipping paper 16 is provided with a circumferential series of vents 36 which overlie the channel 32. Clearly, in the absence of obstructions, ventilating air is able to pass through the tipping paper and through the base of the channel 32 into the chamber 30 when the smoker draws on the cigarette.

Figure 2:
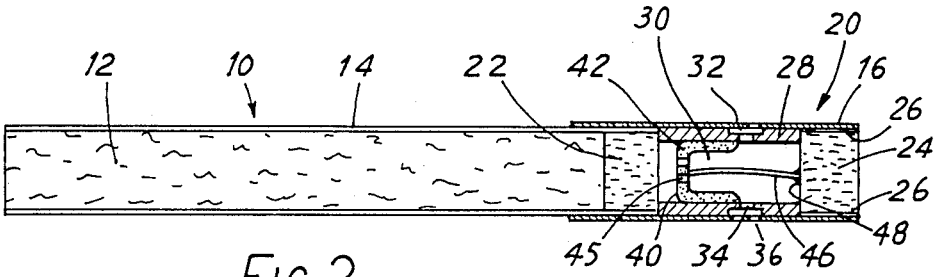
FIG. 2 is a longitudinal cross-section through a first embodiment of an assembled cigarette according to FIG. 1.
Figure 3:
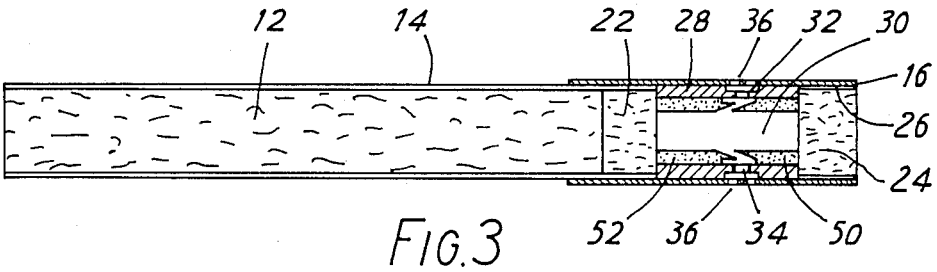
FIG. 3 is a longitudinal cross-section through a second embodiment of an assembled cigarette according to FIG. 1.
Figure 4:
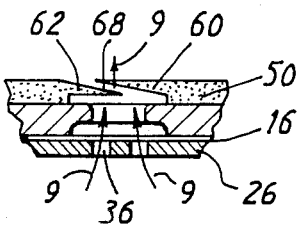
FIG. 4 is a detail view of a portion of the filter assembly shown in FIG. 3; and, FIG. 5 is an exploded perspective view of two hollow cylindrical components of the filter assembly of FIG. 3.

Referring now to a first embodiment of the invention which is described with reference to FIGS. 1 and 2, there is shown, slidably mounted within the tube 28, a piston 40 made of synthetic resin. The piston 40 has a crown 42, and a skirt 44 extending towards filter element 24 (i.e. the filter element at the mouth end of the assembly). The crown 42 is provided with at least a pair of apertures 45, providing means for tobacco combustion products to flow through the piston from the upstream (i.e. the tobacco end) of the chamber 30 to the downstream end (i.e. mouth end) of the chamber 30.

Unrestricted, the piston 40 would naturally slide the length of the chamber 30 when a smoker draws on the cigarette, and the depth of the skirt 44 is designed so that when the crown of the piston has travelled about one quarter of the length of the chamber 30 from filter element 22 the apertures 34 in the base of the channel 32 become occluded by the skirt 44 and remain in that condition until and while the piston skirt contacts the inner face of filter element 24.

However, there is provided, moulded to the underside of the piston crown 42, a resilient filament spring 46 which extends along the axis of the chamber 30 to abut the inner face of filter element 24. Movement of the piston 40 towards the mouth end of the filter assembly is therefore resisted by the resilience of the spring 46.

The effect of the above arrangement is that, when a smoker draws on a lighted cigarette incorporating the filter assembly of the invention, combustion products are drawn through filter element 22 into the chamber 30 and ventilating air is simultaneously drawn through the vents 36 into the chamber. However, the flow of combustion products into the chamber 30 will tend to move the piston towards the mouth end of the chamber. At low levels of draw this movement is prevented by the spring 46 and so both combustion products and ventilating air will enter the chamber 30. At high levels of draw the flow of combustion products will overcome the resistance offered by the resilience of the spring 46 and will move the piston mouthwards to a position where the piston skirt 44 will occlude or otherwise shut off the ventilating apertures 34 and prevent ventilating air from entering the chamber.

It is convenient to ensure adequate abutment of the spring 46 against the inner face of filter element 24 by fixing the free end of the spring to the filter element by a small amount of adhesive 48. The spring 46 may alternatively be of a shape other than filamentary, e.g. a coil spring.

Figure 5:
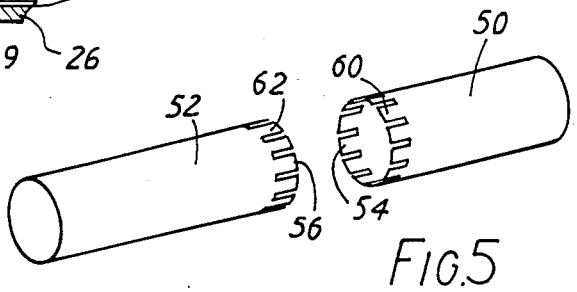

Referring now to a second embodiment of the invention which is described with reference to FIGS. 1 and 3 to 5 of the drawings, there is shown, located within the tube 28, and abutting its inside surface and coaxial therewith, two hollow cylinders 50, 52 made of a synthetic plastics material such as polypropylene. An end of one cylinder 50 abuts the inner face of filter element 24, and likewise an end of the other cylinder 52 abuts the inner face of filter element 22. The other ends 54, 56 of the cylinders 50, 52 are respectively located in the vicinity of the apertures 34 in the tube 28. Each of these ends 54, 56 is cut into a circumferential series of longitudinal flaps 60, 62 by a series of slots 64, 66 parallel to the axis of each cylinder 50, 52 respectively and extending longitudinally along the cylinders from the ends 54, 56 respectively, as shown in FIG. 5. The thickness of each flap 60, 62 tapers from the full wall thickness of its respective cylinder longitudinally towards its respective end 54, 56.

The lengths of the cylinders 50, 52 are such that the flaps 60, 62 overlap each other immediately over the apertures 34 in the tube 28. Further, the flaps are shaped so that when they overlap there will normally be a space 68 (FIG. 4) between their adjacent surfaces. Accordingly, ventilating air will be able to follow the path into the chamber 30 indicated by arrows 9 in FIG. 4.

The flexibility of the flaps 60, 62 is such that if the flow of the tobacco combustion products in the chamber 30 results in a pressure differential in the chamber greater by a predetermined amount than that exerted by the incoming ventilating air on flap 60 then the pressure within the chamber 30 will close flap 60 against flap 62, thereby occluding or shutting off aperture 34, and thus prevent ventilating air from entering the chamber.

The resilience of the flaps 60, 62 is such that when the pressure in the chamber 30 is reduced then the flaps 60, 62 part and permit ventilating air to re-enter the chamber through the aperture 34. Flaps 60, 62 thus act as flap valves.

The effect of the arrangement of the second embodiment described above is that when a smoker draws on a lighted cigarette incorporating the filter assembly of the invention combustion products are drawn through filter element 22 into the chamber 30 and ventilating air is simultaneously drawn through the vents 36 into the chamber where it mixes with the combustion products. The mixture then passes through filter element 24 into the smoker's mouth. At low levels of draw there is no restriction on the ingress of ventilating air through the flap valves 60, 62. At high levels of draw, however, the flow of combustion products in the chamber 30 increases the pressure against flaps 60 and causes them to close on flaps 62 and thus prevent further ventilating air from entering the filter.

Alternative forms of the second embodiment may provide alternative designs of flap means controlled by the pressure in the chamber 30, for governing the amount of ventilating air delivered to the filter assembly.

It is part of the practice of smoking a cigarette that a smoker will tend to take a relatively heavy draw on the cigarette at the commencement of a smoke so that substantial quantities of ventilating air are drawn in through the cigarette paper 14 downstream of the burning tip, thus ensuring a cool organoleptic effect. As the unsmoked length of tobacco diminishes, a correspondingly smaller amount of ventilating air gets through the cigarette paper 14 and the smoker naturally tends to take lighter draws on the cigarette.

If these phenomena are considered in the light of the present invention it will be appreciated that at the commencement of a smoke, when the smoker takes a heavy draw on the cigarette, the pressure differential inside the filter assembly will cut off the air ventilation system of the filter itself, either, as in the first embodiment, by causing the piston skirt 44 to occlude the apertures 34, or, as in the second embodiment, by causing flaps 60 to close on flaps 62, and the smoker will experience only the air entering the cigarette through the cigarette paper.

However, at a later stage in the smoking of the cigarette, when relatively little ventilating air is being drawn in through the cigarette paper, and the smoker is taking light draws on the cigarette, the reduced pressure in the filter assembly will now permit extra ventilating air to enter through the side apertures of the filter, either, as in the first embodiment, because the resilience of the filament spring 46 moves the piston away from its occluding relationship with the apertures 34, or, as in the second embodiment, because the reduced pressure permits the flaps 60, 62 to part. The smoker is thus enabled to get more ventilating air than he would otherwise have expected and therefore continues to experience a cool organoleptic effect.

In some applications of the invention is will be convenient to dispense with the circumferential channel 32, so that the vents 36 in the tipping paper 16 deliver ventilating air directly to the apertures 34.

The synthetic resins or plastics materials used in the filter assembly of the present invention will be synthetic polymers chosen for their thermal and chemical stability under smoking conditions, and for their physiological inertness. Typical resins or plastics materials contemplated in the invention are olefinic polymers, such as polypropylene.

We claim:

1. For attachment to a rod of smokable material, an improved filter assembly of the type, wherein ventilation is provided for a cavity associated with the rod so that combustion products from said rod are intermingled with ventilation air in said cavity before proceeding to a user, the improvement comprising, (a) first and second axially spaced cylindrical filter plug elements, (b) a cylindrical tube of air-impervious material open at both ends connecting said filter elements and in axial alignment with said filter elements, the tube including at least one ventilating aperture therein, (c) a tipping wrapper encasing the cylindrical surfaces of the filter elements and the tube, and including ventilation means overlying said at least one ventilating aperture, and, (d) resilient valve means for preventing the passage of ventilating air through said at least one ventilating aperture when a predetermined pressure differential between the ventilating air flow through said at least one ventilating aperture and the flow of combustion products through the tube is exceeded, and for permitting the passage of ventilating air through said at least one ventilating aperture when said pressure differential is not exceeded, said resilient valve means being movable between a first position in which the flow of ventilating air through said ventilation aperture is permitted and a second position in which the flow of air through said ventilation aperture is prevented, said valve means being resiliently biased towards said first position and being displaceable towards said second position when said pressure differential is exceeded.

2. A filter assembly as claimed in claim 1 wherein the resilient valve means comprises a resiliently mounted piston axially slidable within the tube so as to be resiliently urged from a said second position towards a said first position in the tube, the piston having a crown provided with an aperture therein to permit the passage of combustion products therethrough, the piston, in said second position thereof, acting to seal off said at least one ventilating aperture and in said first position thereof, acting to uncover said at least one ventilating aperture uncovered by the piston, the resilient mounting of the piston being such as to urge the piston from the first region towards the second region and the resilience of the mounting being such that a predetermined flow of combustion products through the assembly will overcome the resilience so as to re-position the piston in the first region.

3. A filter assembly as claimed in claim 2 wherein the resilient mounting of the piston is provided by a compression spring effecting a connection between the base of the piston and a face of the second filter element.

4. A filter assembly as claimed in claim 3 wherein the compression spring comprises a filament spring.

5. A filter assembly as claimed in claim 2 wherein the piston and the resilient mounting therefor are a one-piece moulding of plastic material.

6. A filter assembly as claimed in claim 2 wherein the resilient valve means comprises a flap valve means associated with said at least one ventilating aperture.

7. A filter assembly as claimed in claim 6 wherein the flap valve means comprises by a pair of overlapping members, one of which is flexible, each member being provided by an end portion of a respective one of a pair of opposed hollow cylinders of a synthetic resin located within and coaxial with the tube.

8. A filter assembly as claimed in claim 7 wherein each overlapping member tapers towards its free end.

9. A filter assembly as claimed in claim 1 wherein the tube is provided with a circumferential channel in its outer surface, such that said at least one ventilating aperture lies in the base of the channel and provides communication between the channel and the interior of the tube, and the ventilation means of the tipping wrapper overlies the channel.

10. A filter assembly as claimed in claim 1 wherein the ventilation means in the tipping wrapper comprises a circumferential series of ventilation holes.

11. A filter assembly as claimed in claim 1 wherein a series of said at least one ventilating apertures are spaced circumferentially round the tube.

12. A cigarette comprising the combination of a wrapped rod of smokable material with a filter assembly as claimed in claim 1.

13. A filter assembly as claimed in claim 1 wherein the ventilation means in the tipping wrapper comprises a circumferential region of high porosity paper.

* * * * *